US007913670B2

(12) United States Patent
Holtz

(10) Patent No.: US 7,913,670 B2
(45) Date of Patent: Mar. 29, 2011

(54) VENTURI JET STRUCTURE FOR FUEL DELIVERY MODULE OF A FUEL TANK

(75) Inventor: Raymond Holtz, Auburn Hills, MI (US)

(73) Assignee: Continental Automotive Systems US, Inc., Auburn Hills ( * ) Notice: Subject to any disclaimer, the term of this patent is extended or adjusted under 35 U.S.C. 154(b) by 409 days.

(21) Appl. No.: 12/213,264

(22) Filed: Jun. 17, 2008

(65) Prior Publication Data

US 2009/0020894 A1 Jan. 22, 2009

Related U.S. Application Data

(60) Provisional application No. 60/936,404, filed on Jun. 18, 2007.

(51) Int. Cl.
*F02M 37/04* (2006.01)
*F04F 5/00* (2006.01)

(52) U.S. Cl. ..... 123/509; 417/151

(58) Field of Classification Search ..... 123/509, 123/514; 417/151

See application file for complete search history.

(56) References Cited

U.S. PATENT DOCUMENTS

| | | | | | |
|---|---|---|---|---|---|
| 3,729,273 | A * | 4/1973 | Shimrony | 417/79 |
| 4,503,885 | A * | 3/1985 | Hall | 137/574 |
| 4,886,031 | A * | 12/1989 | Scheurenbrand et al. | 123/516 |
| 4,911,134 | A * | 3/1990 | Olsson | 123/514 |
| 5,016,670 | A * | 5/1991 | Sasaki et al. | 137/574 |
| 5,070,849 | A * | 12/1991 | Rich et al. | 123/509 |
| 5,139,000 | A * | 8/1992 | Sawert | 123/514 |
| 5,218,942 | A * | 6/1993 | Coha et al. | 123/514 |
| 5,289,810 | A * | 3/1994 | Bauer et al. | 123/510 |
| 5,396,872 | A * | 3/1995 | Ruger et al. | 123/514 |
| 5,797,373 | A * | 8/1998 | Kleppner et al. | 123/495 |
| 5,960,775 | A * | 10/1999 | Tuckey | 123/509 |
| 6,109,299 | A * | 8/2000 | Hashimoto et al. | 137/574 |
| 6,123,511 | A * | 9/2000 | Sertier | 417/87 |
| 6,155,793 | A * | 12/2000 | Tuckey et al. | 417/87 |
| 6,213,726 | B1 * | 4/2001 | Tuckey | 417/199.1 |
| 6,269,800 | B1 * | 8/2001 | Fischerkeller et al. | 123/514 |
| 6,425,378 | B1 * | 7/2002 | Frank | 123/514 |
| 6,502,558 | B1 * | 1/2003 | Brunel | 123/509 |
| 6,505,644 | B2 | 1/2003 | Coha et al. | |
| 6,705,298 | B2 * | 3/2004 | Ramamurthy et al. | 123/509 |
| 6,907,899 | B2 * | 6/2005 | Yu et al. | 137/565.22 |
| 6,951,208 | B2 * | 10/2005 | Milton | 123/509 |

(Continued)

FOREIGN PATENT DOCUMENTS

EP 1 443 205 A 8/2004

(Continued)

*Primary Examiner* — Thomas N Moulis

(57) ABSTRACT

A fuel delivery system includes a fuel tank having at least a main chamber. A reservoir is disposed in the main chamber. A fuel pump and venturi jet structure are provided in the reservoir. The venturi jet structure includes a jet inlet having a nozzle for receiving fuel from the fuel pump. A fuel inlet tube structure has a first end associated with the nozzle and a second end extending into a portion of the fuel tank. A mixing tube is in communication with, and downstream of, the jet inlet and the fuel inlet tube structure. An outlet is in communication with, and downstream of, the mixing tube. A length of the fuel inlet tube structure is greater than a length of the outlet, and the mixing tube is mounted so that an axis thereof is generally horizontal ±39.90 degrees with respect to the bottom surface of the reservoir.

20 Claims, 2 Drawing Sheets

U.S. PATENT DOCUMENTS

| | | | | |
|---|---|---|---|---|
| 6,955,158 | B2 * | 10/2005 | Rumpf | 123/514 |
| 6,988,491 | B2 * | 1/2006 | Burhenne et al. | 123/509 |
| 7,007,677 | B2 * | 3/2006 | Toki et al. | 123/509 |
| 7,077,109 | B2 * | 7/2006 | Lee | 123/514 |
| 7,117,856 | B2 * | 10/2006 | Honda et al. | 123/514 |
| 7,216,633 | B2 * | 5/2007 | Attwood et al. | 123/509 |
| 7,303,378 | B2 * | 12/2007 | Kleppner et al. | 417/87 |
| 7,353,807 | B2 * | 4/2008 | Paluszewski | 123/509 |
| 7,387,111 | B2 * | 6/2008 | Yu et al. | 123/509 |
| 2002/0112700 | A1 | 8/2002 | Iwamoto et al. | |
| 2003/0111060 | A1 * | 6/2003 | Ito et al. | 123/509 |
| 2003/0213477 | A1 | 11/2003 | Ramamurthy et al. | |
| 2004/0011337 | A1 * | 1/2004 | Buehler | 123/514 |
| 2005/0241621 | A1 | 11/2005 | Kieninger et al. | |
| 2007/0189908 | A1 * | 8/2007 | Akiyama et al. | 417/151 |
| 2009/0223492 | A1 * | 9/2009 | Leppert | 123/509 |

FOREIGN PATENT DOCUMENTS

| | | | |
|---|---|---|---|
| JP | 2000 257526 | A | 9/2000 |
| JP | 2001 020900 | A | 1/2001 |

* cited by examiner

VENTURI JET STRUCTURE FOR FUEL DELIVERY MODULE OF A FUEL TANK

This application claims the benefit of the earlier filing date of U.S. Provisional Application No. 60/936,404, filed on Jun. 18, 2007, which is hereby incorporated by reference into this specification.

FIELD OF THE INVENTION

The invention relates to fuel delivery modules for automobile vehicles and, more particularly, to a venturi jet structure that can operate within a wide range of mounting orientations.

BACKGROUND OF THE INVENTION

A venturi jet of a fuel delivery module is used to draw fuel from a fuel tank into a separate reservoir inside of the fuel tank. A fuel pump delivers fuel from the reservoir to the engine of a vehicle. An example of the use of a venturi tube in a fuel delivery module using a single chamber fuel tank is disclosed in U.S. Pat. No. 6,951,208, the content of which is hereby incorporated by reference into this specification.

With reference to FIG. 1, a conventional venturi jet structure is shown generally indicated at 10 that is employed in a single chamber fuel tank. The structure 10 includes a jet inlet 12 having a nozzle 13. The inlet 12 receives fuel from a pump (not shown) and as the fuel flow through the nozzle; a vacuum is created to draw fuel into inlet 14. The inlets 12 and 14 are disposed upstream of a reduced diameter mixing tube 16. The mixing tube 16 is connected with an outlet 18. A fuel tank bottom is indicated at 22. Table 1 below shows the different mounting options for the venturi jet structure 10 of FIG. 1. These five options require significant vertical packaging space.

TABLE 1

| Options | Inlet to Outlet Ratio | Typical Angle C |
|---|---|---|
| 1 | A < B | +90 deg or −90 deg |
| 2 | A = B | +90 deg or −90 deg |
| 3 | A < B | 0 deg or 180 deg |
| 4 | A > B | 0 deg or 180 deg |
| 5 | A = B | 0 deg or 180 deg |

In Table 1, the angle C of 90 degrees (plus or minus) indicates that the venturi jet structure 10 is horizontally disposed with respect to the axis E of the mixing tube 16 (e.g., parallel to the bottom 22 of the tank).

In dual chamber fuel tank applications, only one side of the tank (main side) is equipped with a fuel pump. The second side of the tank contains usually only the level sensor unit. Since there will be fuel in the second side of the dual chamber fuel tank, it has to be pumped over to the main side. There are currently two concepts known to do this: 1), a venturi jet same as option no. 1 or 3 above (e.g., the jet is physically located on the second side, driven by a return flow coming into the second side or by a flow from the main side), or 2), a venturi jet same as option no. 2 or 4 or 5 (e.g., the jet is physically located on the main side). The second concept is preferred due to cost, since there is no need for two tubes from the main side to the second side and this allows for tighter integration into the main fuel module.

There is a need provide a venturi jet structure that can be mounted within a wide range of orientations on a main side of a fuel tank and that reduces packaging space and cost.

SUMMARY OF THE INVENTION

An object of the disclosed embodiments is to fulfill the need referred to above. In accordance with the principles of a disclosed embodiment, this objective is obtained by providing a fuel delivery system including a fuel tank having at least a main chamber. A reservoir, having a bottom, is disposed in the main chamber.

A fuel pump and venturi jet structure are provided in the reservoir. The venturi jet structure includes a jet inlet constructed and arranged to receive fuel from the fuel pump. The jet inlet includes a nozzle. A fuel inlet tube structure has a first end associated with the nozzle and a second end extending into a portion of the fuel tank. A mixing tube is in communication with, and downstream of, the jet inlet and the fuel inlet tube structure. An outlet is in communication with, and downstream of, the mixing tube. The venturi jet structure is constructed and arranged such that when fuel is passed through the nozzle, a vacuum is created to draw fuel from the portion of the fuel tank via the fuel inlet tube structure, through the mixing tube, and out of the outlet. A length of the fuel inlet tube structure is greater than a length of the outlet, and the mixing tube is mounted so that an axis thereof is generally horizontal ±39.90 degrees with respect to the bottom surface of the reservoir.

In accordance with another aspect of a disclosed embodiment, a fuel delivery system includes a fuel tank having at least a main chamber. A reservoir, having a bottom, is disposed in the main chamber. A fuel pump and means for drawing fuel are disposed in the reservoir. The means for drawing fuel includes an inlet constructed and arranged to receive fuel from the fuel pump. The inlet includes means for creating a vacuum. A fuel inlet tube structure has a first end associated with the means for creating a vacuum and a second end extending into a portion of the fuel tank. A mixing tube is in communication with, and downstream of, the inlet and the fuel inlet tube structure. An outlet is in communication with, and downstream of, the mixing tube. The means for drawing fuel is constructed and arranged such that when fuel is passed through the means for creating a vacuum, a vacuum is created to draw fuel from the portion of the fuel tank via the fuel inlet tube, through the mixing tube, and out of the outlet. A length of the fuel inlet tube structure is greater than a length of the outlet, and the mixing tube is mounted so that an axis thereof is generally horizontal ±39.90 degrees with respect to the bottom surface of the reservoir.

Other objects, features and characteristics of the present invention, as well as the methods of operation and the functions of the related elements of the structure, the combination of parts and economics of manufacture will become more apparent upon consideration of the following detailed description and appended claims with reference to the accompanying drawings, all of which form a part of this specification.

BRIEF DESCRIPTION OF THE DRAWINGS

The disclosed embodiments will be better understood from the following detailed description of the preferred embodiments thereof, taken in conjunction with the accompanying drawings, wherein like reference numerals refer to like parts, in which.

DETAILED DESCRIPTION OF THE EXEMPLARY EMBODIMENT

For a given performance of a venturi jet, the jet has a given total length. This length does not change with the orientation (e.g. horizontally or vertically oriented or anything in-between). A more powerful and/or more efficient jet typically requires a longer length. Most dual chamber fuel tanks have a rather shallow design, making it difficult to package a fuel delivery module into it. A vertically oriented jet takes away directly from the available height the fuel module has to be packaged in, limiting the design and performance of the fuel delivery module. A more powerful jet is needed for cars with high engine output. A more efficient jet is needed for reducing the jet (inlet) flow. The flow comes from the fuel pump in addition to required engine fuel consumption, so less jet flow means a less powerful pump is needed. This decreases cost and current draw of the pump (enables higher miles per gallon for the vehicle).

Figure 1:
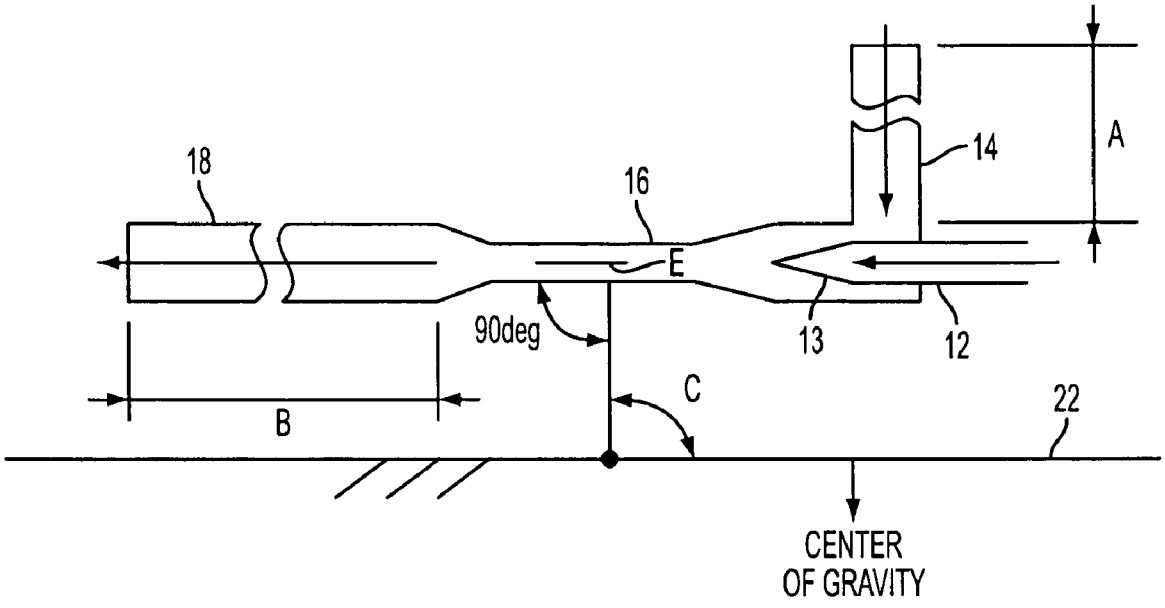
FIG. 1 PRIOR ART
FIG. 1 is a view of a conventional venturi jet structure for a fuel delivery module of a vehicle used in a single chamber fuel tank.
Figure 2:
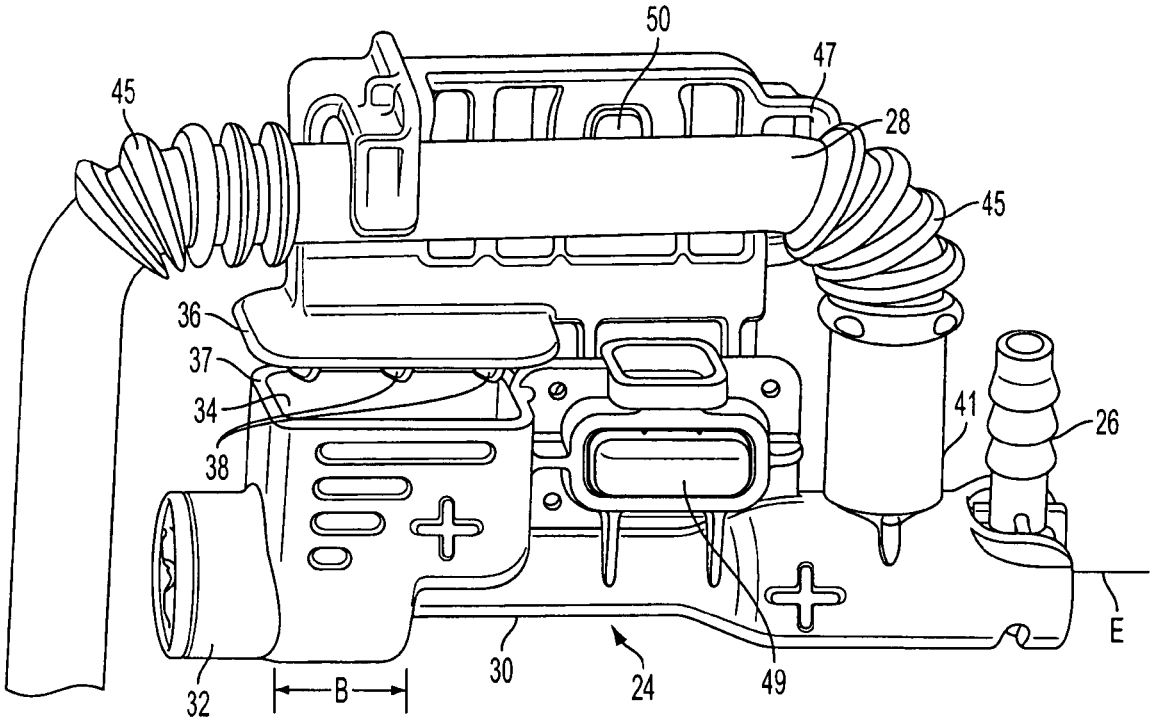
FIG. 2 is a front view of a venturi jet structure provided in accordance with the principles of a disclosed embodiment.

With reference to FIG. 2 a front view of a venturi jet structure is shown, generally indicated at 24, in accordance with a disclosed embodiment. The venturi jet structure 24 is able to be packaged generally horizontally (or within the angle range C in Table 2 below) and therefore provides an advantage in regard to cost and performance of a fuel delivery module. Thus, the embodiment of FIGS. 2 and 3 defines an option 6 as indicated in Table 2, with the parameters defined in FIG. 1).

TABLE 2

| Option | Inlet to Outlet Ratio | Typical Angle C |
|---|---|---|
| 6 | A > B | +50.10 deg to 129.90 deg |

Figure 3:
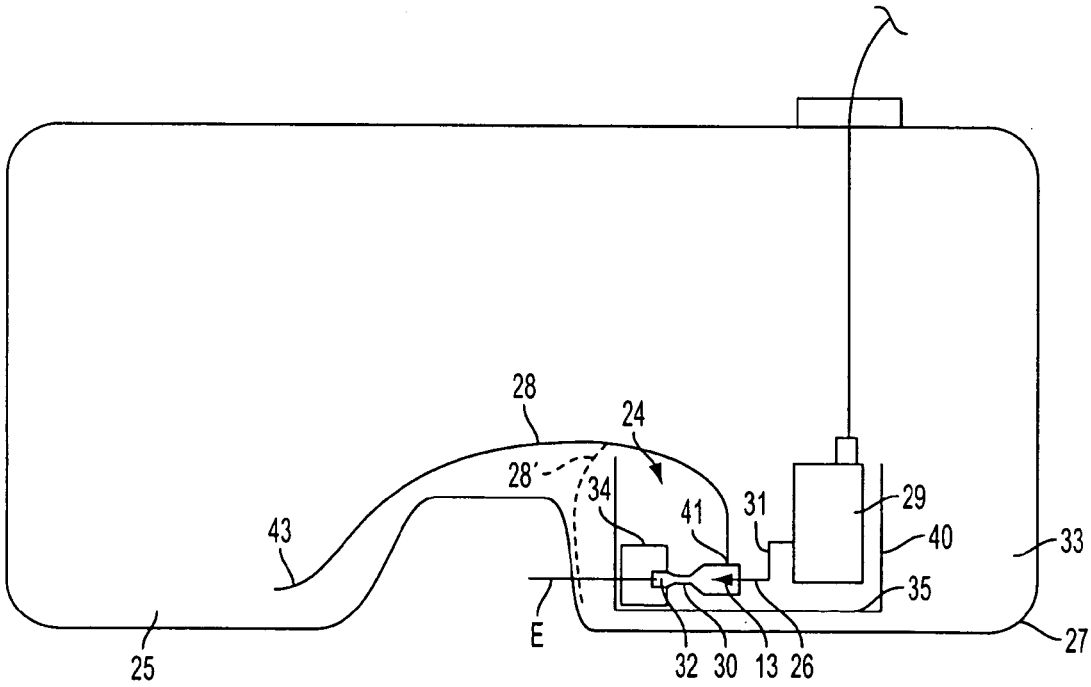
FIG. 3 is a schematic view of a fuel delivery system including the venturi jet structure of FIG. 2 and a fuel pump in a main chamber of a dual chamber fuel tank.

With reference to FIGS. 2 and 3, the venturi jet structure 24 includes a jet inlet 26, including a nozzle 13, which is fed fuel from fuel pump 29 via line 31. A vacuum is created by fuel flowing through the nozzle 13 to draw fuel into an inlet tube structure 28, having an end 41 that is associated with the nozzle 13. The other end 43 of the inlet tube structure 28 extends into the secondary chamber 25 of a dual chamber fuel tank 27. The inlet tube structure 28 includes corrugated, flexible portions 45 such that portions of the inlet tube structure 28 can be bent to orient the inlet tube structure 28 within the fuel tank 27 as desired. Both the inlet 26 and inlet tube structure 28 are upstream of a mixing tube 30. The mixing tube 30 is connected with a preferably tubular outlet 32 and has a diameter less than a diameter of each of the fuel inlet tube structure 28 and outlet 32.

With reference to FIG. 3, and Table 2, the longitudinal axis E of the mixing tube 30 of the venturi jet structure 24 is disposed generally horizontally (horizontal, C=90 deg)±39.90 degrees. In other words, when horizontally disposed, the axis E of the mixing tube 30 is parallel with the bottom surface 35. The venturi jet structure 24 and fuel pump 29 are disposed in the reservoir 40 in a main chamber 33 of the dual chamber fuel tank 27. The dimension A in Table 2 is the length of the inlet tube structure 28. The dimension B is shown in FIG. 2 and is the length of the outlet 32. The length A of the fuel inlet tube structure 28 is greater than the length B of the outlet 32.

With reference to FIG. 3, the inlet tube structure 28 can include a tube portion 28' that is disposed in the main chamber 33 of the fuel tank 27 for drawing fuel from the main chamber 28. The length of the tube proton 28' (e.g., dimension A in Table 2) is greater than the length B of the outlet 32. Thus, if the inlet tube structure 28 includes only the tube portion 28', the venturi jet structure 24 can be used in a fuel tank having only a main chamber 33.

In the illustrated embodiment, an optional bucket 34 is provided to keep the mixing tube 30 filled with fuel. In the embodiment, the bucket 34 is made integral with the outlet 32. Thus, fuel is expelled generally horizontally into the bucket 34 and the bucket fills vertically with fuel. This fuel will reduce the time it takes to "start" the venturi jet structure 24 (in order to create a vacuum the system has to be hydraulically "sealed"). A deflector 36 is preferably provided over an opened end 37 of the bucket 34, and spaced therefrom. The deflector 36 is preferably part of a bracket 45 that holds a portion of the inlet tube 28. The bracket 47 is coupled to the venturi jet structure 24 at connection 49. The bracket 47 includes clip structure 50 constructed and arranged to couple the bracket 47 to the reservoir 40 thereby mounting the venturi jet structure 24 within the reservoir 40. The underside of the deflector 36 facing the open end 37 of the bucket 34 preferably includes baffles or ribs 38 such that the deflector 36 prevents uncontrolled vertical fuel to spray out of the bucket 34. Such uncontrolled fuel spray causes vapor generation, noise and reduces the amount of fuel being filled into the reservoir (as it could splash outside of it). Thus, the deflector 36 is constructed and arranged to deflect the spray of fuel from the vertical direction.

When the fuel pump operates, fuel from the pump 29 is sent through the nozzle 13 creating a vacuum to draw fuel from the secondary chamber 25 and/or the main chamber 33 of the fuel tank 27 via inlet tube structure 28 into the mixing chamber 30. Fuel then exits the outlet 32 and cup 34 and dumps into the reservoir 40 to keep fuel in the reservoir to be pumped to the engine by the fuel pump 29. Since the venturi jet structure 24 is disposed in the main chamber 33, only one tube (e.g., main poring of the tube structure 28) is needed to extend into the secondary chamber 25. Further, since the mixing tube 30 is disposed generally horizontally within the reservoir 40, it reduces vertical packaging space and cost.

The foregoing preferred embodiments have been shown and described for the purposes of illustrating the structural and functional principles of the present embodiments, as well as illustrating the methods of employing the preferred embodiments and are subject to change without departing from such principles. Therefore, the embodiments include all modifications encompassed within the spirit of the following claims.

What is claimed is:

1. A fuel delivery system comprising:

a fuel tank having at least a main chamber, a reservoir having a bottom, the reservoir being separate from the fuel tank and disposed in the main chamber, a fuel pump in the reservoir, and a venturi jet structure disposed in the reservoir, the venturi jet structure comprising:

a jet inlet constructed and arranged to receive fuel directly from the fuel pump, the jet inlet including a nozzle, a fuel inlet tube structure having a first end associated with the nozzle and a second end extending into a portion of the fuel tank, a mixing tube in communication with, and downstream of, the jet inlet and the fuel inlet tube structure, and an outlet in communication with, and downstream of, the mixing tube, wherein the venturi jet structure is constructed and arranged such that when fuel is passed through the nozzle, a vacuum is created to draw fuel from the fuel tank portion via the fuel inlet tube structure, through the mixing tube, and out of the outlet, and wherein a length of the fuel inlet tube structure is greater than a length of the outlet, and the mixing tube is mounted so that an axis thereof is generally horizontal and thus generally parallel with respect to the bottom surface of the reservoir.

2. The system of claim 1, wherein the portion of the fuel tank is the main chamber.

3. The system of claim 1, wherein the fuel tank further includes a secondary chamber, the fuel inlet tube structure including a portion that extends into the secondary chamber and another portion that is disposed in the main chamber so fuel can be drawn from the secondary chamber and the main chamber.

4. The system of claim 1, wherein the outlet is a tubular member and the mixing tube has a diameter less than a diameter of each of the fuel inlet tube structure and the outlet.

5. The system of claim 1, further including a bucket associated with the outlet such that when fuel exits the outlet, it is expelled generally horizontally into the bucket, with the bucket filling vertically with fuel.

6. The system of claim 5, wherein in the bucket is made integral with the outlet.

7. The system of claim 5, further including a deflector provided over an opened end of the bucket and spaced therefrom constructed and arranged to deflect fuel that is vertically expelled from the bucket.

8. The system of claim 7, wherein an underside of the deflector facing the opened end of the bucket includes ribs.

9. The system of claim 7, wherein the deflector is part of a bracket that holds a portion of the fuel inlet tube structure.

10. The system of claim 1, further comprising a bracket coupled to the venturi jet structure, the bracket including clip structure to couple the bracket to the reservoir.

11. A fuel delivery system comprising:

a fuel tank having at least a main chamber, a reservoir having a bottom, the reservoir being separate from the fuel tank and disposed in the main chamber, a fuel pump in the reservoir, and means for drawing fuel disposed in the reservoir, the means for drawing fuel comprising:

an inlet constructed and arranged to receive fuel directly from the fuel pump, the inlet including means for creating a vacuum, a fuel inlet tube structure having a first end associated with the means for creating a vacuum and a second end extending into a portion of the fuel tank, a mixing tube in communication with, and downstream of, the inlet and the fuel inlet tube structure, and an outlet in communication with, and downstream of, the mixing tube, wherein the means for drawing fuel is constructed and arranged such that when fuel is passed through the means for creating a vacuum, a vacuum is created to draw fuel from the portion of the fuel tank via the fuel inlet tube structure, through the mixing tube, and out of the outlet, and wherein a length of the fuel inlet tube structure is greater than a length of the outlet, and the mixing tube is mounted so that an axis thereof is generally horizontal and thus generally parallel with respect to the bottom surface of the reservoir.

12. The system of claim 11, wherein the portion of the fuel tank is the main chamber.

13. The system of claim 11, wherein the fuel tank further includes a secondary chamber, the fuel inlet tube structure including a portion that extends into the secondary chamber and another portion that is disposed in the main chamber so fuel can be drawn from the secondary chamber and the main chamber.

14. The system of claim 11, wherein the outlet is a tubular member and the mixing tube has a diameter less than a diameter of each of the fuel inlet tube structure and the outlet.

15. The system of claim 11, further including a bucket associated with the outlet such that when fuel exits the outlet, it is expelled generally horizontally into the bucket, with the bucket filling vertically with fuel.

16. The system of claim 15, wherein in the bucket is made integral with the outlet.

17. The system of claim 15, further including a deflector provided over an opened end of the bucket and spaced therefrom constructed and arranged to deflect fuel that is vertically expelled from the bucket.

18. The system of claim 17, wherein an underside of the deflector facing the opened end of the bucket includes ribs.

19. The system of claim 17, wherein the deflector is part of a bracket that holds a portion of the fuel inlet tube structure.

20. The system of claim 11, further comprising a bracket coupled to the venturi jet structure, the bracket including clip structure to couple the bracket to the reservoir.

* * * * *